US005464367A

United States Patent [19]

Zink, Jr.

[11] Patent Number: 5,464,367

[45] Date of Patent: Nov. 7, 1995

[54] SANDING TOOL FOR CONNECTION WITH A ROTATING DRIVE

[76] Inventor: Richard W. Zink, Jr., 7659 Inkster Rd. Lot N1, Westland, Mich. 48185

[21] Appl. No.: 253,717

[22] Filed: Jun. 3, 1994

[51] Int. Cl.[6] ..... B24B 23/03

[52] U.S. Cl. ..... 451/441; 451/357

[58] Field of Search ..... 51/170 PT, 241 B, 51/241 A, 241 R, 170 MT, 241 G; 451/357, 441, 431, 415, 438, 358, 359

[56] References Cited

U.S. PATENT DOCUMENTS

| | | | |
|---|---|---|---|
| 1,417,228 | 5/1922 | Blocker | 51/241 G |
| 1,425,286 | 8/1922 | Quarles | 451/360 |
| 1,664,896 | 4/1928 | Perdue | 51/241 G |
| 1,785,065 | 12/1930 | Aborn | 451/358 |
| 2,553,688 | 5/1951 | Thompson | 51/241 R |
| 2,722,789 | 11/1955 | Robins | 51/170 MT |
| 2,794,303 | 6/1957 | Wickes | 451/344 |
| 2,848,850 | 8/1958 | Metoff | 51/170 MT |
| 3,550,324 | 12/1970 | Gerry | 451/359 |
| 3,871,138 | 3/1975 | Welsch | 451/358 |
| 4,774,789 | 10/1988 | Amalfi | 51/170 TL |
| 4,825,597 | 5/1989 | Matechuk | 51/392 |
| 4,885,815 | 12/1989 | Smith | 15/28 |

FOREIGN PATENT DOCUMENTS

| | | |
|---|---|---|
| 261422 | 4/1968 | Austria . |
| 1031993 | 6/1953 | France . |

*Primary Examiner*—Robert A. Rose

*Attorney, Agent, or Firm*—Harness, Dickey & Pierce

[57] ABSTRACT

A dual action sanding attachment has a drive mechanism, a connecting mechanism and an orbiting element. The driven connecting mechanism is coupled with the drive mechanism which, in turn, is coupled with the orbiting element to drive the orbiting element to sand or buff a desired surface.

5 Claims, 2 Drawing Sheets

SANDING TOOL FOR CONNECTION WITH A ROTATING DRIVE

BACKGROUND AND SUMMARY OF THE INVENTION

The present invention relates to sanding tools and more particularly, to a sanding tool which is attached to a rotating drive source to sand hard to reach places.

In various fields of endeavor, such as auto body repair, mold making and prototype applications, various types of tools are utilized in these fields. Various types of sanders or buffers are used to repair or form various parts. Also, different types of machinery, such as grinders or the like are also utilized in these fields. Ordinarily, each tool is its own separate tool and thus a mechanic must put forth a substantial amount of capital to purchase each particular tool which performs each particular function.

Also, in some applications, the application requires the use of a tool which can work on remote areas where large machinery is incapable of working on these areas. In these cases, special tools, having their own power sources, are available to perform the specific functions. Thus, in order to work on these hard to access places, the mechanic must again purchase an additional tool.

This continual purchasing of additional tools, which have their own separate power sources, becomes very expensive to the mechanic. In turn, the expense of the machinery is passed on to the consumer in paying a higher cost for his bodywork, machining or the like. Thus, it would be desirable to have an attachment which could be utilized with an already purchased machine.

It is an object of the invention to provide an attachment which is readily acceptable by a die grinder or the like which the mechanic ordinarily possesses. The present invention provides a sander which may be utilized in hard to reach areas which can be adaptable to be powered by a pneumatic die grinder. The present invention, in the auto body field, would enable sanding of door jambs, louvers, rocker panels, lower valences, headlight buckets or the like. Also, in mold working, the invention would enable the sanding of female mold cavities, for sanding ductwork or any other type of application which would be too small for a regular dual action sander.

From the following detailed description taken in conjunction with the accompanying drawings and subjoined claims, other objects and advantages: of the present invention will become apparent to those skilled in the art.

DETAILED DESCRIPTION OF THE PREFERRED EMBODIMENTS

Figure 1:
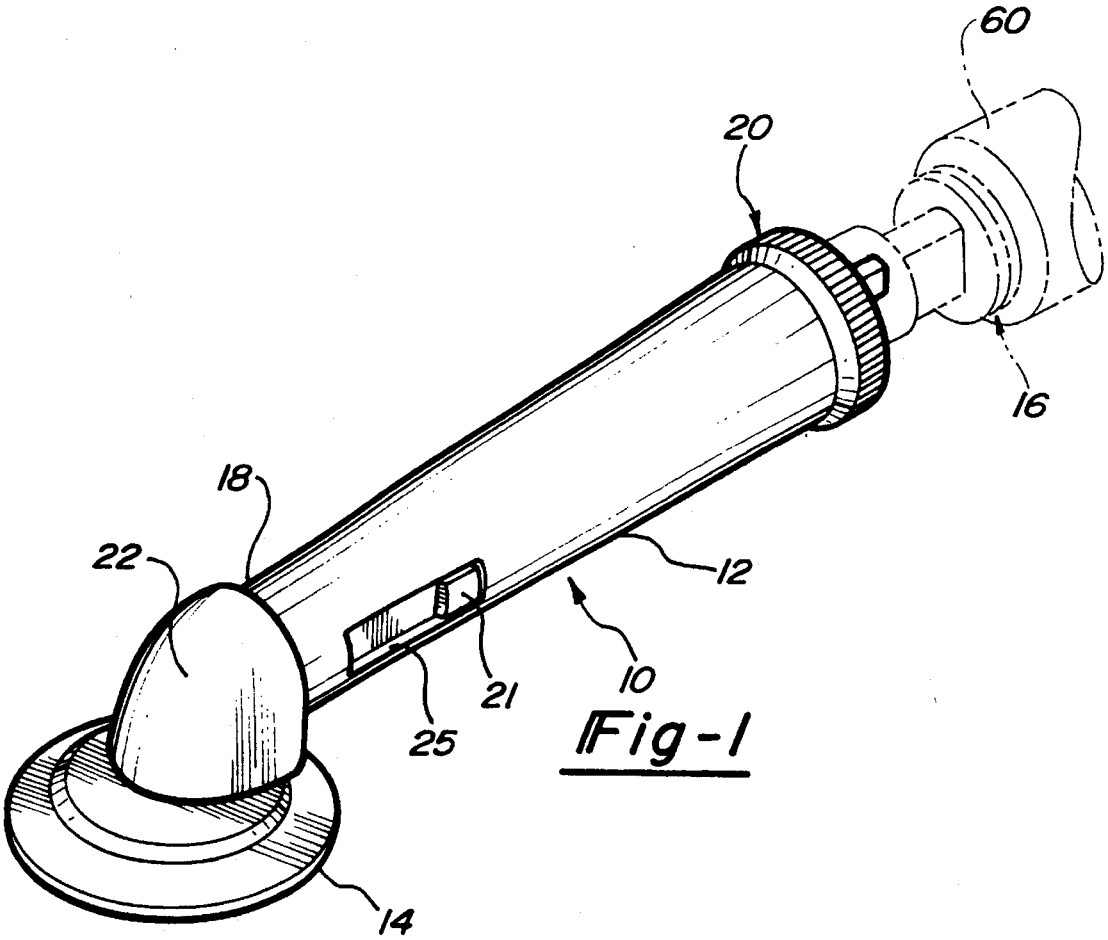
FIG. 1 is perspective view of a dual action sander attachment in accordance with the present invention.
Figure 4:
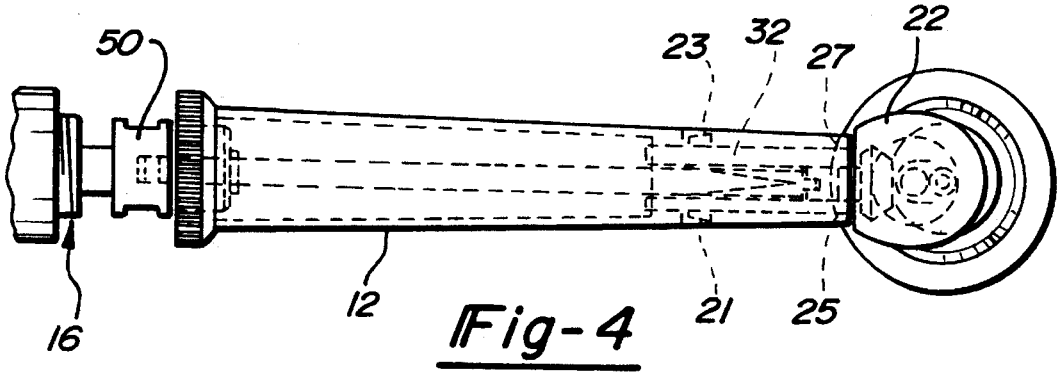
FIG. 4 is a top plan view of the sander of FIG. 1.
Figure 2:
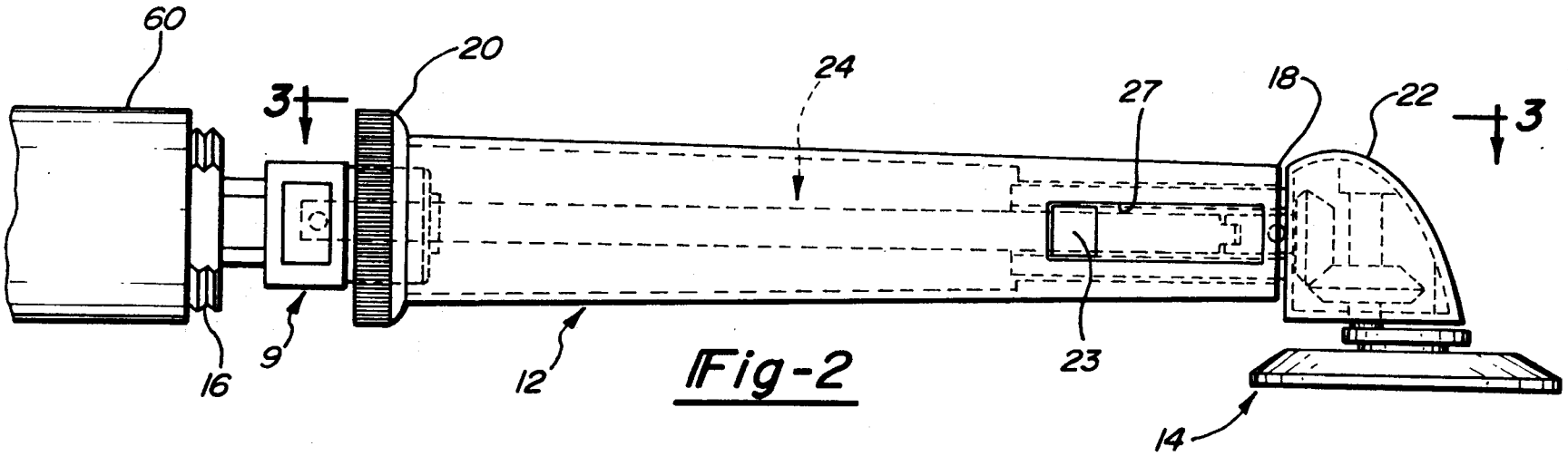
FIG. 2 is a side plan view of the sander of FIG. 1.

Referring to the drawings, particularly FIG. 1, a dual action sander attachment is illustrated and designated with the reference numeral 10. The sander attachment 10 includes a housing 12, an orbiting element 14 and a connecting member 16.

The housing 12 includes two ends, 18 and 20. One end 18 includes a head portion 22, while the other end 20 is threaded onto the die connecting thread 16. The housing has an overall elongated tubular shape. A through bore 17 is defined by the housing 12 to enable drive mechanism 24 and die grinder mechanism 9 to be positioned within the housing 12.

Figure 3:
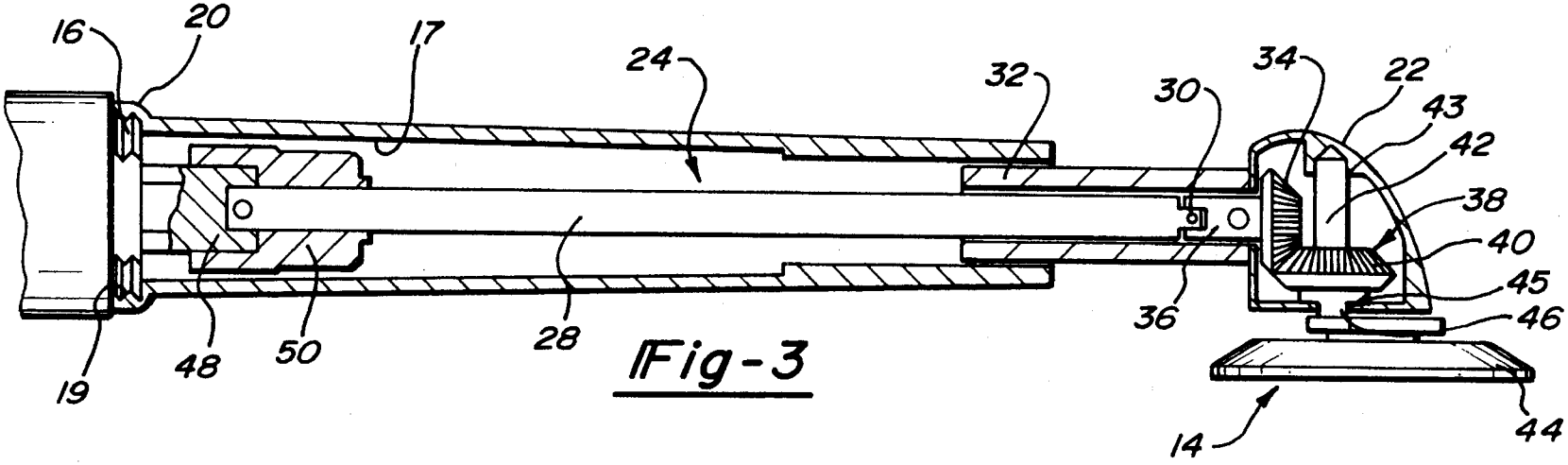
FIG. 3 is a cross-sectional view of FIG. 2 along line 3—3 thereof.

The end 20, with threads 19 is threaded onto the connecting thread 16 of the die grinder as seen in FIG. 3. The drive 24 includes a shaft 28 coupled with the drive mechanism 9. The shaft 28 defines a first longitudinal axis extending through the elongated tubular housing 12. The shaft 28 has a wedge shaped end which couples with a coupling 30 positioned within a bearing sleeve 32. At the end of the coupling 30 a gear 34, which includes a shaft 36, is connected with the coupling 30. Thus, as drive passes from the drive mechanism 9 to the shaft 28 the gear 34 rotates.

A pair of tabs 21 and 23 extends through housing slots 25 and 27. The tabs 21 and 23 and slots 25 and 27 engage the housing 12 to telescope as the housing 12 is threadedly connected with the die grinder. The housing 12 slidingly telescopes bearing sleeve 32. The tabs 21 and 23 are integral with the sleeve 32, which is coupled with the housing head 22.

A second gear member 38 is positioned within the housing head 22. The second gear member 38 includes a gear 40 and a shaft 42. The shaft 42 is secured within a holding element 43 in the head housing 22. The gear 40 meshes with the gear 34 providing rotational movement to the orbiting member 14. The gear member 38 also includes a bore or a shaft 45 which couples the orbiting element 14. The shaft 42 defines a second axis which is substantially perpendicular to the first axis of the shaft 28. Thus, the drive is passed from gear 34 to gear 40 which, in turn, rotates the orbital member 14.

The orbital member 14 includes a disk member 44 and a shaft member 46. The shaft is positioned with respect to the disk 44 such that it is an eccentric shaft. The shaft 46 has an axis parallel to the shaft 42 and, may be collinear therewith. The orbital member 14 may include a sanding member or a buffing member depending upon the particular application of the tool 10.

The grinder drive 9, as best seen in FIG. 3, includes a spindle 48 and a coupling 50. The spindle 48 generally has a polygonal cross-section which may be rectangular, hexagonal or any desired shape which fits the particular die grinder. Also, the spindle 48 could have a circular cross-section.

Thus, the spindle 48 is connected with the die grinder 60 and it may be locked therein to provide drive to the drive means 24. As the die grinder rotates, the connecting mechanism 16 likewise rotates which in turn, via the drive mechanism 24, rotates the orbiting element 14.

While it will be apparent that the preferred embodiments of the invention disclosed are well calculated to provide the advantages and features above stated, it will be appreciated that the inventionis susceptible to modification, variation, and change without departing from the proper scope or fair meaning of the subjoined claims.

What is claimed is:

1. A sanding apparatus comprising:

an elongated tubular housing having a first and second end and defining a longitudinal axis;

an orbiting element including an abrasive element;

drive means for rotating said orbiting element, said drive means positioned in said housing;

a connecting sleeve for threadably engaged with a threaded end of a die grinder, said connecting sleeve coupled at said first end of said housing;

means for connecting said drive means to the die grinder, said connecting means coupled with said drive means for driving said drive means and said connecting means positioned at said first end of said housing; and said orbiting element including means for coupling with said drive means for rotating said orbiting element, said coupling means including means for enabling telescoping longitudinal movement of said housing for enabling coupling of said housing with the die grinder, said telescoping means including a sleeve enabling movement of said housing along said longitudinal axis, said orbiting element positioned at the second end of said housing and coupled with said sleeve.

2. The sanding apparatus according to claim 1 wherein said housing is an elongated tube.

3. The sanding apparatus according to claim 1 wherein said connecting means includes a shaft adapted for connecting with a die grinder.

4. The sanding apparatus according to claim 3 wherein said shaft has a polygonal cross-section.

5. The sanding apparatus according to claim 1 wherein said connecting means includes a fastening means with said drive means.

* * * * *